US010336503B2

(12) United States Patent
Yourist et al.

(10) Patent No.: US 10,336,503 B2
(45) Date of Patent: Jul. 2, 2019

(54) CONTAINER WITH GRIP STRUCTURE

(71) Applicant: Graham Packaging Company, L.P., York, PA (US)

(72) Inventors: Sheldon E. Yourist, York, PA (US); Raymond A. Pritchett, Jr., Manchester, PA (US); Eric B. Ungrady, Mt. Wolf, PA (US)

(73) Assignee: Graham Packaging Company, L.P., York, PA (US)

( * ) Notice: Subject to any disclaimer, the term of this patent is extended or adjusted under 35 U.S.C. 154(b) by 268 days.

(21) Appl. No.: 14/798,253

(22) Filed: Jul. 13, 2015

(65) Prior Publication Data

US 2017/0015466 A1 Jan. 19, 2017

(51) Int. Cl.

| | |
|---|---|
| ***B65D 23/00*** | (2006.01) |
| ***B65D 23/10*** | (2006.01) |
| ***B65D 1/02*** | (2006.01) |
| ***B65D 1/44*** | (2006.01) |

(52) U.S. Cl.

CPC ..... *B65D 23/102* (2013.01); *B65D 1/0207* (2013.01); *B65D 1/44* (2013.01); *B65D 2501/0036* (2013.01); *B65D 2501/0081* (2013.01)

(58) Field of Classification Search

CPC .... B65D 1/0223; B65D 25/32; B65D 25/325; B65D 25/2897; B65D 2501/0018; B65D 2501/0027; B65D 2501/0036

USPC ..... 215/384

See application file for complete search history.

(56) References Cited

U.S. PATENT DOCUMENTS

| | | | | | |
|---|---|---|---|---|---|
| D262,267 | S | * | 12/1981 | Cox | D9/543 |
| 4,890,752 | A | * | 1/1990 | Ota | B29C 33/005 215/384 |
| 4,993,565 | A | * | 2/1991 | Ota | B65D 23/102 215/384 |
| D323,983 | S | * | 2/1992 | Bastidos | D9/540 |
| 5,141,120 | A | * | 8/1992 | Brown | B65D 1/0223 215/381 |
| 5,141,121 | A | * | 8/1992 | Brown | B65D 1/0223 215/381 |
| 5,226,550 | A | * | 7/1993 | Mikolaitis | B65D 1/0223 215/384 |
| 5,392,937 | A | * | 2/1995 | Prevot | B65D 1/0223 215/396 |

(Continued)

*Primary Examiner* — Ernesto A Grano

(74) *Attorney, Agent, or Firm* — Baker Botts L.L.P.

(57) ABSTRACT

Container includes a top portion, a body portion and a bottom portion. The body portion includes a front wall, a rear wall and first and second side walls, the first side wall disposed opposite the second side wall, opposing grip areas formed in the first and second side walls, a first circumferential rib disposed above the opposing grip areas and extending horizontally about an entire outer circumferential perimeter of the body portion, a second circumferential rib disposed below the opposing grip areas and extending horizontally about the entire outer circumferential perimeter of the body portion, at least one horizontal body rib disposed between and spaced circumferentially from the opposing grip areas, a first vertical strut formed in the first side wall and a second vertical strut formed in the second side wall, each strut disposed between the first and second circumferential ribs and spaced a distance from each grip area.

29 Claims, 6 Drawing Sheets

(56) References Cited

U.S. PATENT DOCUMENTS

| | | | | |
|---|---|---|---|---|
| 5,472,105 | A * | 12/1995 | Krishnakumar | B65D 1/0223 215/384 |
| 6,349,839 | B1 * | 2/2002 | Mooney | B65D 1/0223 215/382 |
| 6,375,025 | B1 * | 4/2002 | Mooney | B65D 1/0223 215/381 |
| 6,439,413 | B1 * | 8/2002 | Prevot | B65D 1/0223 215/381 |
| 7,080,746 | B2 * | 7/2006 | Saito | B65D 23/102 215/381 |
| 7,097,061 | B2 * | 8/2006 | Simpson, Jr. | B65D 1/0223 215/373 |
| 7,296,703 | B2 * | 11/2007 | Lane | B65D 79/02 215/381 |
| 2003/0042222 | A1 * | 3/2003 | Wurster | B65D 1/0223 215/379 |
| 2008/0083696 | A1 * | 4/2008 | Nievierowski | B65D 1/0223 215/384 |
| 2009/0159557 | A1 * | 6/2009 | De Vel | B65D 1/0223 215/384 |
| 2009/0230084 | A1 * | 9/2009 | Yourist | B65D 23/102 215/398 |
| 2011/0011825 | A1 * | 1/2011 | Howell | B65D 1/0223 215/381 |
| 2011/0174829 | A1 * | 7/2011 | Yourist | B65D 1/0223 220/669 |
| 2012/0205341 | A1 * | 8/2012 | Mast | B65D 1/0223 215/382 |
| 2012/0241405 | A1 * | 9/2012 | Lobbestael | B29C 49/04 215/10 |

* cited by examiner

CONTAINER WITH GRIP STRUCTURE

BACKGROUND

Field of the Disclosed Subject Matter

The present disclosed subject matter relates generally to plastic containers, for example a lightweight polymer container for packaging and storing liquids.

Description of Related Art

Many liquids, including beverages, cooking oils, detergents, motor oils, and the like, are often packaged, shipped, and stored in polymer containers. Furthermore, it is often desirable to dispense or otherwise pour the liquid contents from such polymer containers. Thus, it can be desirable for such containers to be lightweight to ease lifting and manipulation of the container by a user. Additionally, a grip can be formed in the container to further facilitate lifting and manipulation of the container to pour the liquid therefrom.

However, such lightweight containers can be highly flexible, and can distort or deflect when gripped. Such distortion or deflection can cause liquid to be urged from the container prior before being poured by the user. This "volcanoing" effect can thus cause undesirable spillage of the liquid when handled by the user.

As such, there is a continued need for a lightweight polymer container with improved body strength to resist unwanted distortion or deflection, for example during gripping and lifting, yet being easy to manipulate to facilitate pouring fluid contents from the container.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a container having a top portion having a finish portion, a body portion disposed below the top portion and a bottom portion disposed below the body portion opposite the top portion. The body portion includes a front wall, a rear wall opposite the front wall and first and second side walls extending between the front wall and the rear wall to define a generally rectangular shape in plan view, the first side wall disposed opposite the second side wall. Opposing grip areas are formed in the first and second side walls, the opposing grip areas including a first grip area formed in the first side wall and a second grip area formed in the second side wall. A first circumferential rib is disposed above the opposing grip areas and extends horizontally about an entire outer circumferential perimeter of the body portion, and a second circumferential rib is disposed below the opposing grip areas and extends horizontally about the entire outer circumferential perimeter of the body portion. At least one horizontal body rib is disposed between the first and second circumferential ribs and spaced from the opposing grip areas. A first vertical strut is formed in the first side wall and spaced from the first grip area, and a second vertical strut is formed in the second side wall and spaced from the second grip area. Each of the first and second vertical struts is disposed between and spaced from the first and second circumferential ribs.

Additionally, and as embodied herein, the body portion can have a substantially square shape in plan view. The body portion can include rounded corners at opposing ends of the first and second side walls in plan view.

Furthermore, and as embodied herein, each opposing grip area can have a textured surface formed therein. Additionally or alternatively, each opposing grip area can have an elongated recess formed therein. The opposing grip areas can be disposed on the first and second side walls closer to the rear wall than the front wall. Each opposing grip area can project inwardly a distance between 10% and 20% of a greatest width of the rear wall. The container can include a transition portion along the outer circumferential perimeter to an upper portion of each opposing grip area defining an angle between 45 degrees and 70 degrees from the outer circumferential perimeter to each opposing grip area. The rear wall can include a contour defining at least a portion of the opposing grip areas.

In addition, and as embodied herein, the first circumferential rib and the second circumferential rib can have substantially equal depths. The first and second circumferential ribs each can have a depth between 3% and 5% of a width of the first and second side walls.

In some embodiments, the first circumferential rib and the at least one horizontal body rib can have a substantially equal depth. The at least one horizontal body rib can have a depth between 3% and 5% of a width of the first and second side walls. The at least one horizontal body rib can be formed in the front wall. The at least one horizontal body rib can extend from the front wall about rounded corners disposed between the front wall and the first and second side walls, respectively. The at least one horizontal body rib can include a plurality of horizontal body ribs, and in some embodiments, can include four horizontal body ribs. Each of the plurality of horizontal body ribs can be spaced vertically an equal distance from each adjacent horizontal body rib. The plurality of horizontal body ribs can be spaced vertically an equal distance from the first and second circumferential ribs.

Additionally, and as embodied herein, the body portion can include at least one opposing horizontal body rib formed in the rear wall. The at least one opposing horizontal body rib can include a plurality of opposing horizontal body ribs, and in some embodiments, can include four opposing horizontal body ribs.

Furthermore, and as embodied herein, each vertical strut can be disposed between and spaced from a corresponding one of the first and second grip areas and the at least one horizontal body rib. Each vertical strut can have a depth between 2% and 5% of a width of the front wall.

In some embodiments, the container can be a blow-molded structure. The container can include polyethylene terephthalate. Additionally or alternatively, the container can have a volume of about 59 ounces formed from a preform having a mass of about 58 grams.

According to another aspect, the disclosed subject matter includes a container having a top portion having a finish portion, a body portion disposed below the top portion and a bottom portion disposed below the body portion opposite the top portion. The body portion includes a front wall, a rear wall opposite the front wall and first and second side walls extending between the front wall and the rear wall to define a generally rectangular shape in plan view, the first side wall disposed opposite the second side wall. Opposing grip areas are formed in the first and second side walls, the opposing grip areas including a first grip area formed in the first side wall and a second grip area formed in the second side wall.

The container includes one or more strengthening features selected from the group consisting of at least one circumferential rib spaced from the opposing grip areas and extending horizontally about an entire outer circumferential perimeter of the body portion, at least one horizontal body rib spaced about the outer circumferential perimeter from the opposing grip areas, and at least one vertical strut formed in at least one of the first side wall and the second side wall, the at least one vertical strut spaced from the opposing grip areas. The container exhibits approximately a 200% decrease in displacement of volume upon application of a force of 2.27 lbs. to at least one of the opposing grip areas compared to a substantially similar container without the strengthening features.

The disclosed subject matter also includes a method of making a container having some or all of the features described herein. As recognized in the art, the container disclosed herein can include some or all of the features described herein, or any suitable combination thereof.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION

Figure 1:
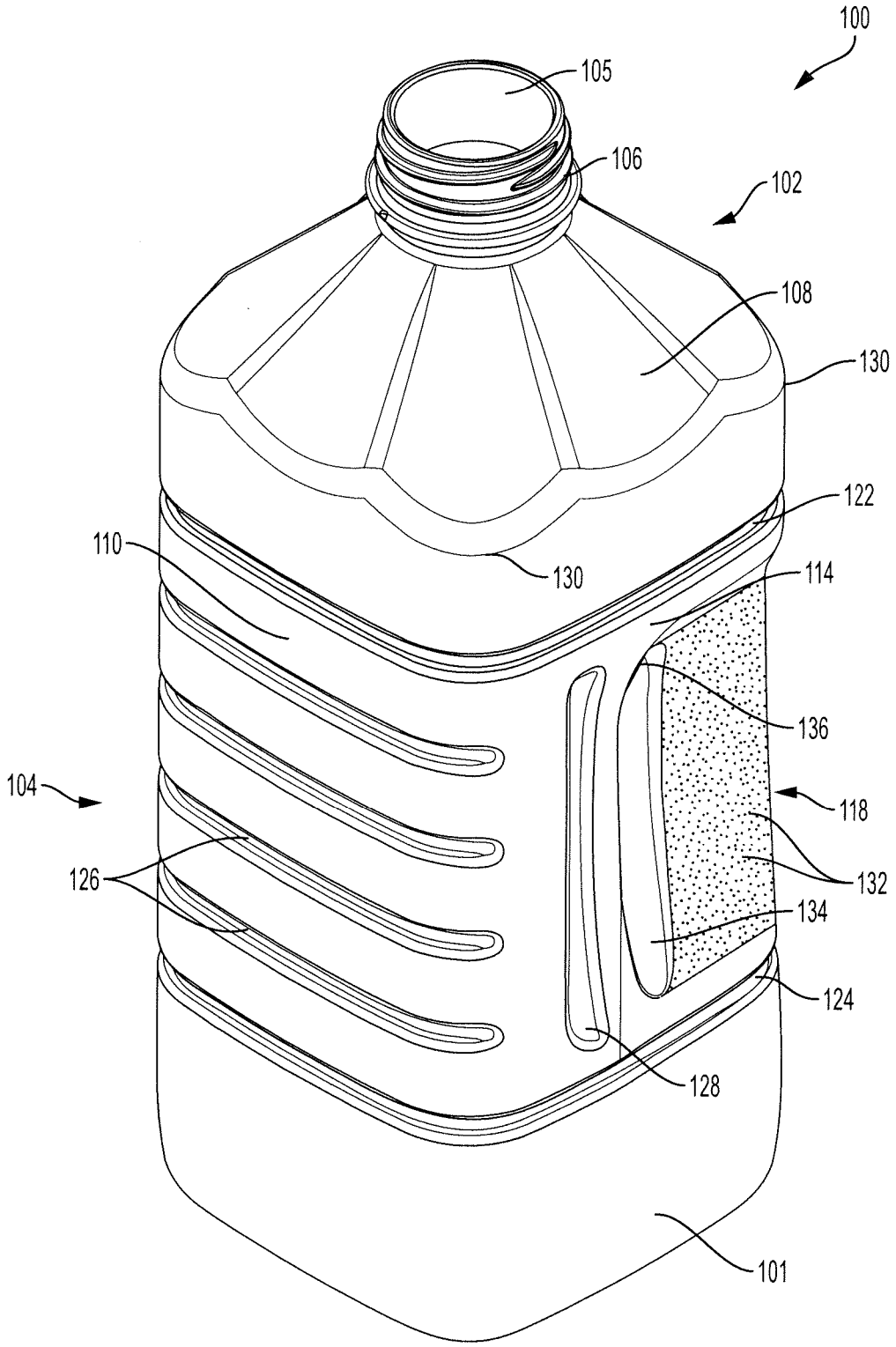
FIG. 1 is a top right perspective view of an exemplary embodiment of a container in accordance with the disclosed subject matter.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The apparatus and methods presented herein can be used for transport of perishable or nonperishable liquids. The disclosed subject matter is particularly suited for packaging, storing, and dispensing beverages, including fruit and vegetable juices.

In accordance with the disclosed subject matter herein, the container generally includes a top portion having a finish portion, a body portion disposed below the top portion and a bottom portion disposed below the body portion opposite the top portion. The body portion includes a front wall, a rear wall opposite the front wall and first and second side walls extending between the front wall and the rear wall to define a generally rectangular shape in plan view, the first side wall disposed opposite the second side wall. Opposing grip areas are formed in the first and second side walls, the opposing grip areas including a first grip area formed in the first side wall and a second grip area formed in the second side wall. A first circumferential rib is disposed above the opposing grip areas and extends horizontally about an entire outer circumferential perimeter of the body portion, and a second circumferential rib is disposed below the opposing grip areas and extends horizontally about the entire outer circumferential perimeter of the body portion. At least one horizontal body rib is disposed between the first and second circumferential ribs and spaced from the opposing grip areas. A first vertical strut is formed in the first side wall and spaced from the first grip area, and a second vertical strut is formed in the second side wall and spaced from the second grip area. Each of the first and second vertical struts disposed between and spaced from the first and second circumferential ribs.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the container in accordance with the disclosed subject matter are shown in FIGS. 1-7. The container is suitable for use with a wide variety of liquids. As used herein, the terms "front," "rear," "side," "top," and "bottom" are used for the purpose of illustration only, and not limitation. That is, it is recognized that the terms "front," "rear," "side," "top," and "bottom" are interchangeable and are merely used herein as a point of reference.

For purpose of illustration, and not limitation, reference is made to the exemplary embodiment of a container 100 shown in FIGS. 1-7. As shown in FIGS. 1-4, container 100 generally includes a top portion 102, a body portion 104 disposed below top portion 102 and a bottom portion 101 disposed below body portion 104 opposite top portion 102. Top portion 102 can include a finish portion 106, which can have a neck portion 108 extending therefrom. Finish portion 106 can define an opening 105 to the interior 103 of container 100 and can include an engagement for a closure to cover opening 105. Finish portion 106 can include any suitable engagement for a container closure, for example and without limitation, an internal or external threaded engagement, neck-time and lever wire engagement, non-threaded cap engagement, groove-ring wax seal, or any other suitable container closure engagement. Neck portion 108 can extend from finish portion 106 to body portion 104. For example, and as embodied herein, neck portion 108 can extend radially outward from finish portion 106, and can have a contoured shape, which can include a plurality of segments or fluting to define the contoured shape of neck portion 108.

Body portion 104 can extend from top portion 102 and includes a front wall 110, a rear wall 112 opposite the front wall, and first and second side walls 114, 116 extending between front wall 110 and rear wall 112. As embodied herein, first side wall 114 can be disposed opposite second side wall 116.

Body portion 104 can have any suitable shape. For example and without limitation, body portion 104 can have a shape compatible with a manufacturing technique for the container and/or a product processing technique to process the contents of container 100. For purpose of illustration and not limitation, container 100 can have a shape compatible for use in a sterilization and/or pasteurization processes to sterilize or pasteurize food product contents contained in container 100. For example and without limitation, body portion 104 can have a generally rectangular shape in plan view, and as embodied herein, body portion 104 of container 100 can have a substantially square shape in plan view. Such shapes can be compatible for use with certain equipment used for sterilization and/or pasteurization, such as a high pressure processing (or high pressure preservation or HPP) food processing apparatus. Alternatively, body portion 104 can have a substantially round shape, triangular shape, or any other suitable shape. Additionally or alternatively, and as embodied herein, body portion 104 can include one or more rounded corners 130 disposed at opposing ends of the front and back walls 110, 112 and the first and second side walls 114, 116.

Figure 3:
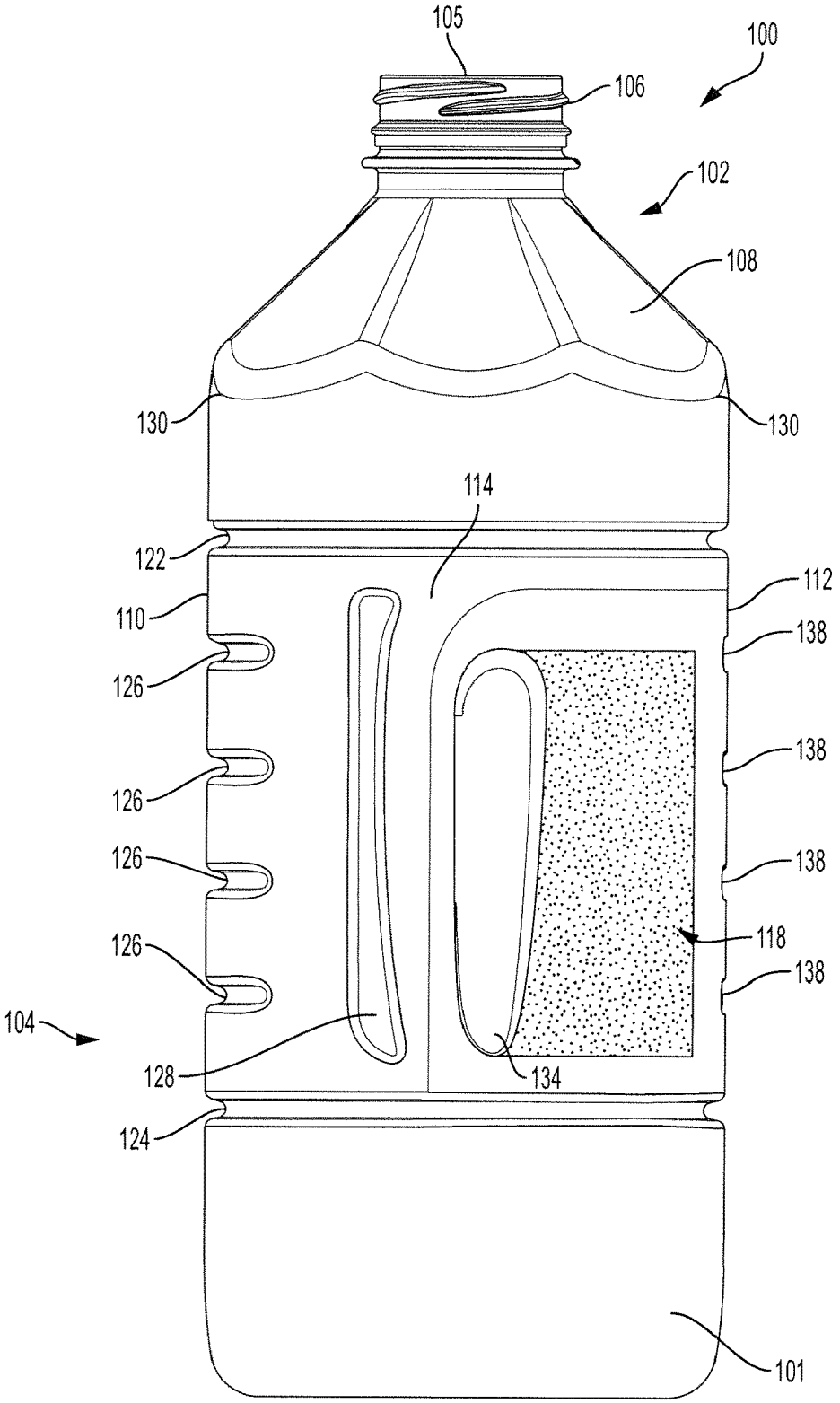
FIG. 3 is a right side view of the container of FIG. 1, the left side being a mirror image thereof.
Figure 4:
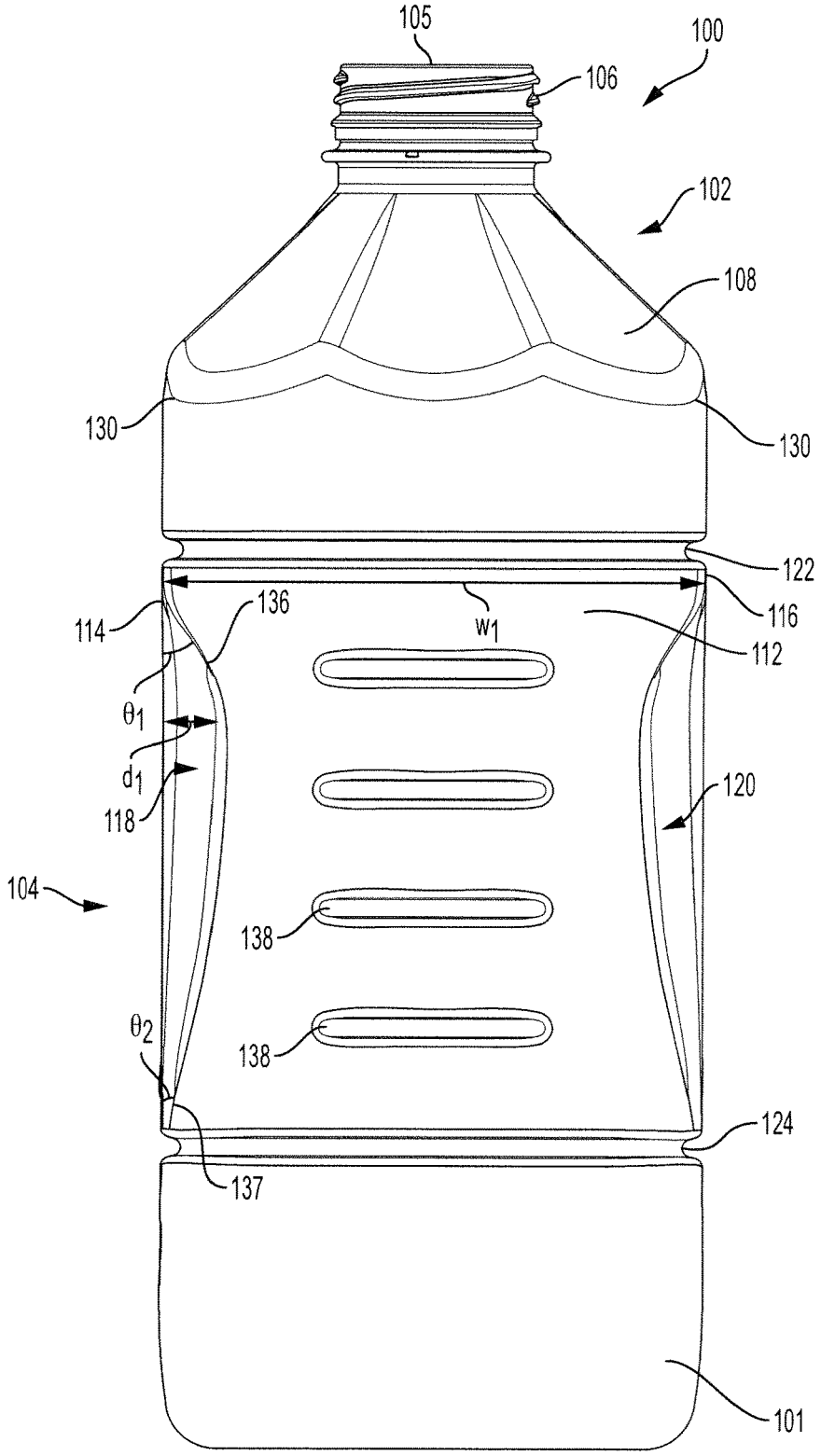
FIG. 4 is rear view of the container of FIG. 1.

With reference to FIGS. 1, 3 and 4, body portion 104 can include one or more gripping areas to facilitate gripping, lifting and/or manipulation of container 100. As embodied herein, opposing grip areas 118, 120 can be formed in the first and second side walls 114. 116, respectively. Additionally, and as embodied herein, each opposing grip area 118, 120 can have one or more transition portions defining a contour extending inwardly from an outer surface of first and second side walls 114, 116, respectively. As shown in FIG. 4, for purpose of illustration and not limitation, each opposing grip area 118, 120 can have a first contour 136 at an upper portion thereof and extending inward from the respective first or second side wall 114, 116 to define an angle $\theta_1$ relative the first or second side wall 114, 116. Additionally or alternatively, and as embodied herein, each opposing grip area 118, 120 can have a second contour 137 at a lower portion thereof and extending inward from the respective first or second side wall 114, 116 to define an angle $\theta_2$ relative the first or second side wall 114, 116. For purpose of illustration and not limitation, as embodied herein, angle $\theta_1$ can be greater than angle $\theta_2$, and in some embodiments, angle $\theta_1$ can be within a range of about 45 degrees to 70 degrees, and angle $\theta_2$ can be within about 70 degrees to 90 degrees. Additionally, and as embodied herein, each opposing grip area 118, 120 can project inwardly a distance $d_1$ relative a greatest width $w_1$ of rear wall 112, and thus distance $d_1$ can be between about 10% to 20% of width $w_1$ of rear wall 112, and in some embodiments, distance $d_1$ can be about 14.4% of width $w_1$ of rear wall 112. Furthermore, as shown in FIG. 4 and as embodied herein, rear wall 112 can define at least a portion of first contour 136 and/or second contour 137, and thus define at least a portion of opposing grip areas 118, 120.

Additionally, and as embodied herein, opposing grip areas can include one or more gripping features formed therein. For example, and as embodied herein, opposing grip areas 118, 120 each can include a textured surface 132, which can facilitate gripping and/or prevent slipping by providing increased friction along the textured portion of opposing grip areas 118, 120.

Furthermore, and as embodied herein, gripping features of opposing grip areas can include one or more recesses formed therein. For example, and as embodied herein, opposing grip areas 118, 120 each can include an elongated recess 134 proximate an end of opposing grip areas 118, 120. Each elongated recess 134 can be disposed proximate a central portion first and second side walls 114, 116, and thus, elongated recesses 134 can oppose each other across interior 103 to facilitate gripping of container 100 at opposing portions of first and second side walls 114, 116. In this manner, each elongated recess 134 can be sized, for purpose of illustration and not limitation, to receive at least a portion of one or more fingers of a user to facilitate gripping of container 100 by the user proximate elongated recesses 134.

Walls of container 100, including front and rear walls 110, 112 and first and second side walls 114, 116, can have a flexibility such that the walls can distort or deflect when inward pressure is applied thereto. For purpose of illustration and not limitation, when inward pressure is applied to first and second side walls 114, 116 proximate each elongated recess 134, for example to grip container 100 to lift and/or manipulate container 100 for pouring, first and second side walls 114, 116 can deflect inwardly, which can at least temporarily reduce the interior volume of container 100. As such, when first and second side walls 114, 116 are gripped or otherwise deflected inward, contents of container 100 can be displaced toward opening 105. Sufficient inward deflection can urge at least a portion of the contents of container 100 out of opening 105, which can cause unwanted spillage or "volcanoing" of the contents when sufficient inward force is applied to first and second side walls 114, 116, e.g., due to gripping, lifting or manipulating of container 100. Such flexibility of the walls of container 100 can be due at least in part to relatively lightweight materials that can be used to form container 100, which can further facilitate lifting and/or manipulating of container 100, as discussed further herein.

As embodied herein, container 100 can include one or more strengthening features, which can reduce or inhibit distortion and/or deflection of the walls of container 100, for example due to gripping, lifting or manipulating of container 100. For purpose of illustration and not limitation, and as embodied herein, strengthening features formed in body portion 104 can include one or more circumferential ribs. As embodied herein, a first circumferential rib 122 can be formed proximate an upper portion of body portion 104, for example disposed above opposing grip areas 118, 120. For purpose of illustration and not limitation, and as embodied herein, first circumferential rib 122 can extend horizontally about the entire outer circumferential perimeter of body portion 104. Alternatively, first circumferential rib 122 can extend horizontally about a portion of the outer circumferential perimeter of body portion 104. As a further alternative, first circumferential rib 122 can be formed as a plurality of circumferential rib segments each extending horizontally about a portion of the outer circumferential perimeter of body portion 104.

Container 100 can include any number of circumferential ribs, which can be spaced along body portion 104. For purpose of illustration and not limitation, and as embodied herein, a second circumferential rib 124 can be formed proximate a lower portion of body portion 104, for example disposed below opposing grip areas 118, 120. For example, and as embodied herein, second circumferential rib 124 can extend horizontally about the entire outer circumferential perimeter of body portion 104. Alternatively, second circumferential rib 124 can extend horizontally about a portion of the outer circumferential perimeter of body portion 104. As a further alternative, second circumferential rib 124 can be formed as a plurality of circumferential rib segments each extending horizontally about a portion of the outer circumferential perimeter of body portion 104.

Additionally, and as embodied herein, first and second circumferential ribs 122, 124 each can extend inwardly toward interior 103 of container 100. Alternatively, first and/or second circumferential ribs 122, 124 can extend outwardly from interior 103 of container 100. For example and as embodied herein, first and second circumferential ribs 122, 124 can extend an equal depth inwardly toward or outwardly from interior 103 of container 100. Alternatively, first and second circumferential ribs 122, 124 can have different depths. For purpose of illustration and not limitation, first and second circumferential ribs 122, 124 each can have a depth within a range between about 3% and 5% of a width of the first and second side walls, and as embodied herein, first and second circumferential ribs 122, 124 each can have a depth of about 4% of a width of the first and second side walls 114, 116.

Figure 2:
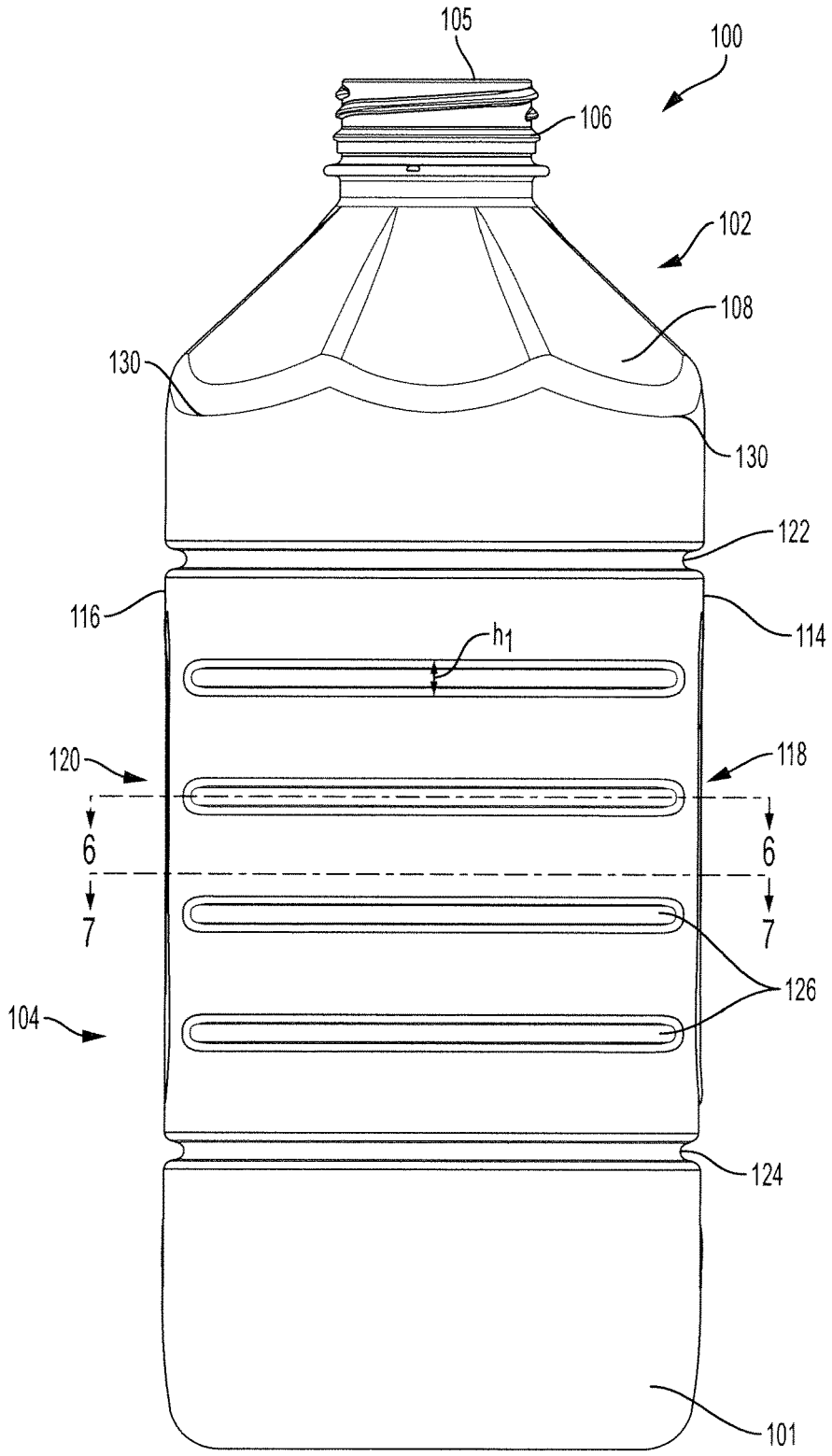
FIG. 2 is a front view of the container of FIG. 1.
Figure 5:
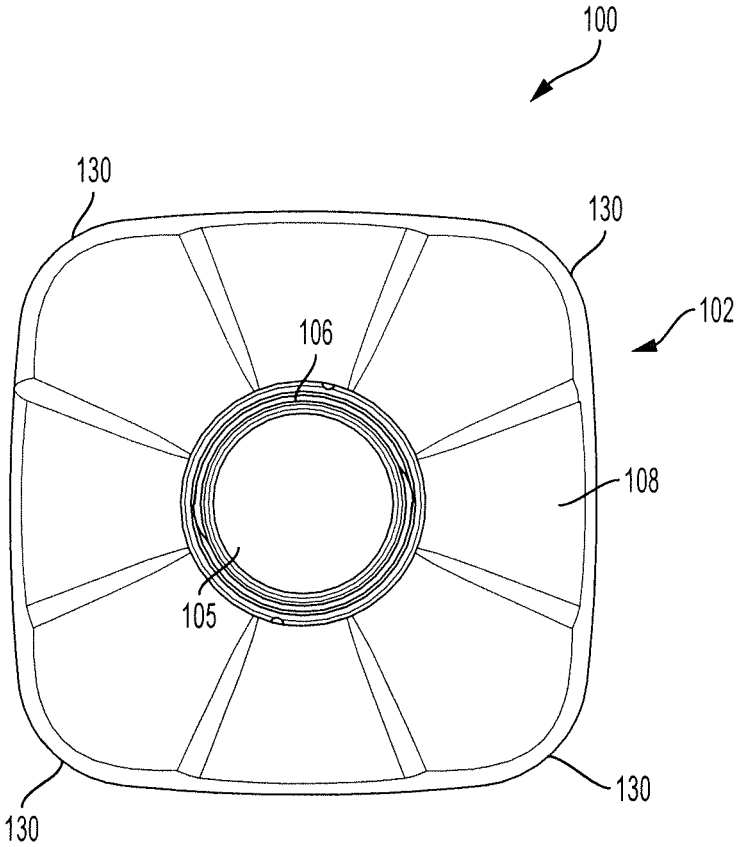
FIG. 5 is a plan view of the container of FIG. 1.
Figure 6:
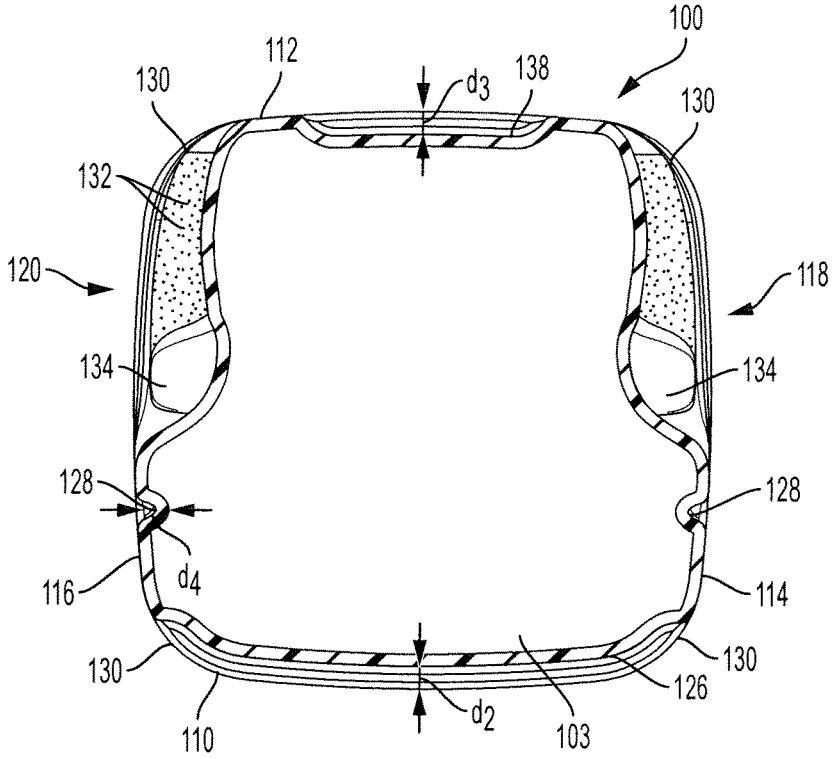
FIG. 6 is a cross-sectional view of the container of FIG. 1, taken along line 6-6 in FIG. 2.
Figure 7:
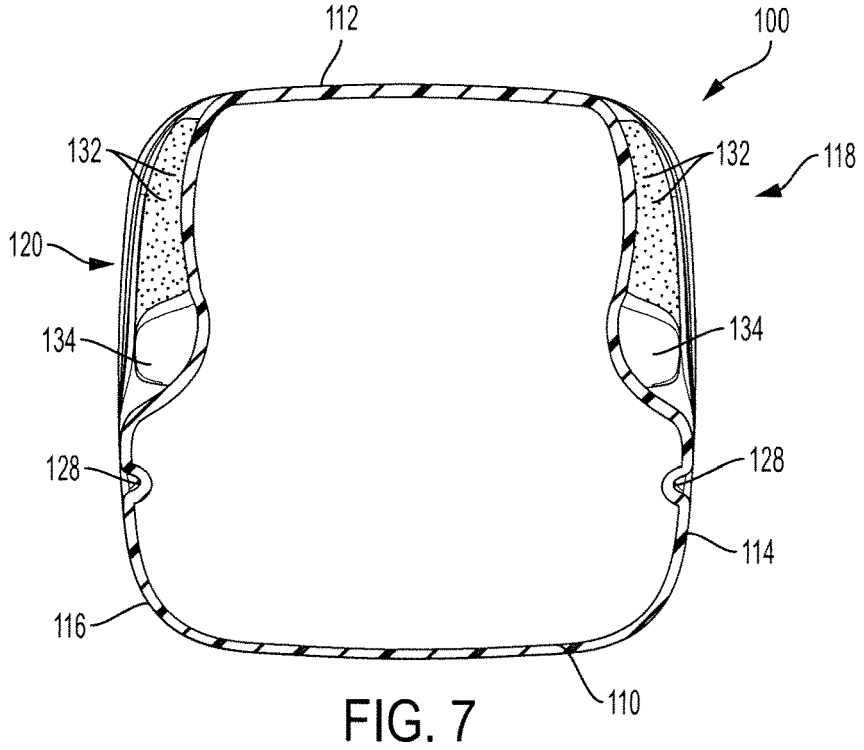
FIG. 7 is a cross-sectional view of the container of FIG. 1, taken along line 7-7 in FIG. 2.

With reference to FIGS. 1-3, and as embodied herein, strengthening features formed in body portion 104 can include at least one horizontal body rib 126 disposed between the first and second circumferential ribs 122, 124 and spaced from the opposing grip areas 118, 120. With reference to FIG. 5, horizontal body rib 126 can have a depth $d_2$ between 3% and 5% of a width of the first and second side walls 114, 116, and as embodied herein, horizontal rib 126 can have a depth $d_2$ of about 4% of a width of the first and second side walls 114, 116. Additionally or alternatively, and as embodied herein, horizontal body rib 126 can have a depth substantially equal to first circumferential rib 122 and/or second circumferential rib 124. In addition or as a further alternative, with reference to FIG. 2, horizontal body rib 126 can have a height $h_1$ between 2% and 4% of a height of container 100, and as embodied herein, horizontal rib 126 can have a height $h_1$ of about 2.7% of a height of container 100. Additionally, and as embodied herein, horizontal body rib 126 can have a height equal to a height of first and second circumferential ribs 122, 124.

As shown in FIGS. 1-3, for example and without limitation, horizontal body rib 126 can be formed in the front wall 110. With reference to FIGS. 3 and 5, for purpose of illustration and not limitation, and as embodied herein, horizontal body rib 126 can extend from the front wall 110 about rounded corners 130 disposed between the front wall 110 and the first and second side walls 114, 116, respectively.

Container 100 can include any number of horizontal ribs 126. For purpose of illustration and not limitation, body portion 104 can include two or more horizontal body ribs 126, and as embodied herein, body portion 104 can include four horizontal body ribs 126. If provided with two or more horizontal body ribs 126, each horizontal body rib 126 can be spaced vertically an equal distance from each adjacent horizontal body rib 126. For example, and as embodied herein, each horizontal body rib 126 can be spaced from each adjacent horizontal body rib 126 a distance between 4% and 15% of a height of the container 100, and as embodied herein, each horizontal body rib 126 can be spaced from each adjacent horizontal body rib 126 a distance of about 8.6% of a height of the container 100. Additionally or alternatively, and as embodied herein, horizontal body ribs 126 can be spaced vertically an equal distance from each other and the first and second circumferential ribs 122, 124.

In addition or as a further alternative, and as embodied herein, body portion 104 can include at least one horizontal body rib 138 formed in the rear wall 112. In this manner, as shown for example in FIG. 5, horizontal body rib 138 can oppose horizontal body rib 126 across the interior 103 of container 100. As such, an as embodied herein, body portion 104 can include two or more horizontal body ribs 138, and as embodied herein, body portion 104 can include four horizontal body ribs 138. If provided with two or more horizontal body ribs 138, each horizontal body rib 138 can be spaced vertically an equal distance from each adjacent horizontal body rib 138. For example, and as embodied herein, each horizontal body rib 138 can be spaced from each adjacent horizontal body rib 138 a distance between 4% and 15% of a height of the container, and as embodied herein, each horizontal body rib 138 can be spaced from each adjacent horizontal body rib 138 a distance of about 8.6% of a height of the container. Additionally or alternatively, and as embodied herein, horizontal body ribs 138 can be spaced vertically an equal distance from each other and the first and second circumferential ribs 122, 124. Furthermore, as shown for example in FIG. 6 and as embodied herein, horizontal body ribs 138 formed in the rear wall 112 can extend horizontally a distance less than horizontal body ribs 126 formed in the front wall 110, which can be due at least in part to opposing grip areas 118, 120 disposed proximate rear wall 112. In this manner, horizontal body ribs 138 can be spaced from each opposing grip area 118, 120. Furthermore, and as embodied herein, horizontal body rib 138 can have a depth $d_3$ between 3% and 5% of a width of the first and second side walls 114, 116, and as embodied herein, horizontal rib 138 can have a depth $d_3$ of about 4% of a width of the first and second side walls 114, 116. In addition, and as embodied herein, horizontal rib 138 can have a height between 2% and 4% of a height of container 100, and as embodied herein, horizontal rib 126 can have a height of about 2.7% of a height of container 100.

With reference to FIGS. 1 and 3, and as embodied herein, strengthening features formed in body portion 104 can include a first vertical strut 128 formed in the first side wall 114 and spaced from the first grip area 118. Additionally or alternatively, and as embodied herein, a second vertical strut 128 can be formed in the second side wall 116 and spaced from the second grip area 120. Additionally, and as embodied herein, each of the vertical struts 128 can be disposed between from the first and second circumferential ribs 122, 124 and can be spaced from each of the first and second circumferential ribs 122, 124. Additionally or alternatively, and as embodied herein, each vertical strut 128 can be disposed between a corresponding one of the first and second grip areas 118, 120 and the horizontal body rib 126, and can be spaced from the horizontal body rib 126.

Additionally, and as embodied herein, each vertical strut 128 can have a depth $d_4$ between 2% and 5% of a width of the first and second side walls 114, 116, and as embodied herein, each vertical strut 128 can have a depth $d_4$ of about 3.4% of a width of the first and second side walls 114, 116.

It is to be recognized that the dimensions and relative proportions of the walls of the containers and strengthening features will vary according to the exact size and intended use of the containers. For purpose of illustration and not limitation, container 100 can have a volume of about 59 fluid ounces (e.g., +/−1 fluid ounce) formed from a preform having a mass of about 58 grams (e.g., +/−1 gram). However, it will be apparent to those skilled in the art that various modifications and variations to the exemplary size, mass, dimensions and/or angles can be made without departing from the spirit or scope of the disclosed subject matter. One of ordinary skill will recognize that any suitable shape container can be employed, and the disclosed subject matter is not limited to the sizes and shapes illustrated in FIGS. 1-7. Other suitable shapes include rectangles, triangles, cylinders, ovals, various polygons, etc., having any suitable dimensions.

In accordance with another aspect of the disclosed subject matter, a method of making a container 100 is provided. It will be understood that the container can be made using any suitable technique, including blow molding, extrusion blow molding, single stage polyethylene terephthalate, two stage polyethylene terephthalate, etc. For example and without limitation, the disclosed containers can be made by the methods disclosed in U.S. Pat. Nos. 8,636,944, 8,585,392, 8,632,867, 8,535,599, 8,544,663, and 8,556,621, each of which is incorporated by reference herein in its entirety. The container can be made from any suitable polymeric materials, including but not limited to low and high density polyethylene, polyethylene terephthalate, polyvinyl chloride, polypropylene, polystyrene, fluorine treated high density polyethylene, post-consumer resin, K-resin, or bioplastic.

According to another aspect, the disclosed subject matter includes a container having a top portion having a finish portion, a body portion disposed below the top portion and a bottom portion disposed below the body portion opposite the top portion. The body portion includes a front wall, a rear wall opposite the front wall and first and second side walls extending between the front wall and the rear wall to define a generally rectangular shape in plan view, the first side wall disposed opposite the second side wall. Opposing grip areas are formed in the first and second side walls, the opposing grip areas including a first grip area formed in the first side wall and a second grip area formed in the second side wall. The container includes one or more strengthening features selected from the group consisting of at least one circumferential rib spaced from the opposing grip areas and extending horizontally about an entire outer circumferential perimeter of the body portion, at least one horizontal body rib spaced about the outer circumferential perimeter from the opposing grip areas, and at least one vertical strut formed in at least one of the first side wall and the second side wall, the at least one vertical strut spaced from the opposing grip areas. The container exhibits approximately a 200% decrease in displacement of volume upon application of a force of 2.27 lbs. to at least one of the opposing grip areas compared to a substantially similar container without the strengthening features.

For purpose of understanding and not limitation, data is provided to demonstrate various operational characteristics achieved by the containers disclosed herein. For purpose of illustration and comparison, samples of a container 100, as depicted in FIGS. 1-7, were compared to samples of a similarly-configured container (Control) without any of the strengthening features described herein. As an initial test, a sample of the Control container was filled with liquid, gripped at opposing gripping areas and lifted by hand, which displaced a volume of liquid from the Control container. By comparison, a sample of container 100 was filled with liquid, gripped at opposing gripping areas and lifted by hand, which did not displace any liquid from container 100.

With reference to Table 1, for purpose of illustration and comparison, samples of the Control container and samples of container 100 were each filled with a similar volume of liquid, a portion of the side wall of each container proximate an elongated recess of the opposing grip areas was deflected inward 0.87 inches, and the peak force to deflect the side wall and the mass of liquid displaced from the container were measured. As shown in Table 1, on average (mean), 2.27 lbs. of force deflected the portion of the side wall of the Control container inward 0.87 inches compared to 3.80 lbs. of force to deflect the portion of the side wall of container 100 the same distance, which is about a 67.4% increase in force. Additionally, as shown in Table 1, on average (mean), deflection of the portion of the side wall of the Control container inward 0.87 inches resulted in 60.8 grams of water (i.e., 60.8 mL of liquid) being displaced from the Control container compared to 35.1 grams of water (i.e., 35.1 mL of liquid) being displaced from container 100 when the portion of the side wall was deflected the same distance, which is about a 57.7% decrease in amount of liquid displaced. As such, deflecting container 100 by a similar amount as the Control container, on average, results in 57.7% less spillage and requires 67.4% more force to create such a deflection.

TABLE 1

| Deflection = 0.87" | | | | |
|---|---|---|---|---|
| | Peak force (lbs.) | | Liquid Displacement (g) | |
| Sample Number | Control | Container 100 | Control | Container 100 |
| 1 | 2.25 | 4.07 | 60.6 | 34.0 |
| 2 | 2.19 | 3.92 | 57.9 | 36.8 |
| 3 | 2.32 | 3.64 | 59.8 | 34.5 |
| 4 | 2.32 | 3.70 | 62.4 | 34.9 |
| 5 | 2.27 | 3.69 | 63.3 | 35.2 |
| Average | 2.27 | 3.80 | 60.8 | 35.1 |
| Std | 0.05 | 0.18 | 2.14 | 1.06 |

With reference to Table 2, for purpose of illustration and comparison, a constant force of 2.27 lbs. was applied to the portion of the side wall of container 100 samples. As shown in Table 1, on average (mean), a force of 2.27 lbs. applied to the portion of side wall of Control container samples displaced 60.8 grams of water (i.e., 60.8 mL of liquid). By comparison, on average (mean), a force of 2.27 lbs. applied to the portion of side wall of container 100 displaced 20.1 grams of water (i.e., 20.1 mL of liquid), which is about a 200% decrease in the amount of liquid displaced.

TABLE 2

| Constant load 2.27 lbs. – Control liquid displacement = 60.8 g | |
|---|---|
| Sample Number | Container 100 Liquid displacement (g) |
| 1 | 17.8 |
| 2 | 22.2 |
| 3 | 24.6 |
| 4 | 18.2 |
| 5 | 17.7 |
| Average | 20.1 |
| Std | 3.14 |

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A container comprising:

a top portion comprising a finish portion;

a body portion disposed below the top portion; and a bottom portion disposed below the body portion opposite the top portion;

the body portion comprising:

a front wall, a rear wall opposite the front wall, first and second side walls extending between the front wall and the rear wall to define a generally rectangular shape in plan view, the first side wall disposed opposite the second side wall, opposing grip areas formed in the first and second side walls, the opposing grip areas including a first grip area formed in the first side wall and a second grip area formed in the second side wall, a first circumferential rib disposed above the opposing grip areas and extending horizontally about an entire outer circumferential perimeter of the body portion, a second circumferential rib disposed below the opposing grip areas and extending horizontally about the entire outer circumferential perimeter of the body portion, at least one horizontal body rib disposed between the first and second circumferential ribs and spaced from the opposing grip areas, and a first vertical strut formed in the first side wall and spaced from the first grip area and a second vertical strut formed in the second side wall and spaced from the second grip area, each of the first and second vertical struts disposed between and spaced from the first and second circumferential ribs and having a length coextensive with a height of the first and the second grip areas respectively, the first and second vertical struts configured to resist radially-inward distortion of the first and second side walls from gripping the opposing grip areas.

2. The container of claim 1, wherein the body portion has a substantially square shape in plan view.

3. The container of claim 1, wherein the body portion comprises rounded corners at opposing ends of the first and second side walls in plan view.

4. The container of claim 1, wherein each opposing grip area has a textured surface formed therein.

5. The container of claim 1, wherein each opposing grip area has an elongated recess formed therein.

6. The container of claim 1, wherein the opposing grip areas are disposed on the first and second side walls closer to the rear wall than the front wall.

7. The container of claim 1, wherein each opposing grip area projects inwardly a distance between 10% and 20% of a greatest width of the rear wall.

8. The container of claim 1, further comprising a transition portion along the outer circumferential perimeter to an upper portion of each opposing grip area defining an angle between 45 degrees and 70 degrees from the outer circumferential perimeter to each opposing grip area.

9. The container of claim 1, wherein the rear wall has a contour defining at least a portion of the opposing grip areas.

10. The container of claim 1, wherein the first circumferential rib and the second circumferential rib have substantially equal depths.

11. The container of claim 1, wherein the first and second circumferential ribs each has a depth between 3% and 5% of a width of the first and second side walls.

12. The container of claim 1, wherein the first circumferential rib and the at least one horizontal body rib have a substantially equal depth.

13. The container of claim 1, wherein the at least one horizontal body rib has a depth between 3% and 5% of a width of the first and second side walls.

14. The container of claim 1, wherein the at least one horizontal body rib is formed in the front wall.

15. The container of claim 14, wherein the at least one horizontal body rib extends from the front wall about rounded corners disposed between the front wall and the first and second side walls, respectively.

16. The container of claim 14, wherein the at least one horizontal body rib comprises a plurality of horizontal body ribs.

17. The container of claim 16, wherein the plurality of horizontal body ribs comprises four horizontal body ribs.

18. The container of claim 16, wherein each of the plurality of horizontal body ribs are spaced vertically an equal distance from each adjacent horizontal body rib.

19. The container of claim 16, wherein the plurality of horizontal body ribs are spaced vertically an equal distance from the first and second circumferential ribs.

20. The container of claim 14, further comprising at least one opposing horizontal body rib formed in the rear wall.

21. The container of claim 20, wherein the at least one horizontal body rib comprises a plurality of horizontal body ribs and the at least one opposing horizontal body rib comprises a plurality of opposing horizontal body ribs.

22. The container of claim 21, wherein the plurality of horizontal body ribs comprises four horizontal body ribs and the plurality of horizontal opposing horizontal body ribs comprises four opposing horizontal body ribs.

23. The container of claim 1, wherein only one vertical strut is formed in the front sidewall and only one vertical strut is formed in the second side wall, each vertical strut is disposed between a corresponding one of the first and second grip areas and the at least one horizontal body rib.

24. The container of claim 1, wherein each vertical strut has a depth between 2% and 5% of a width of the first and second side walls.

25. The container of claim 1, wherein each vertical strut has a varied width along its length.

26. The container of claim 1, wherein the container comprises polyethylene terephthalate.

27. The container of claim 1, wherein the container has a volume of about 59 ounces formed from a preform having a mass of about 58 grams.

28. A container comprising:

a top portion comprising a finish portion;

a body portion disposed below the top portion; and a bottom portion disposed below the body portion opposite the top portion;

the body portion comprising:

a front wall, a rear wall opposite the front wall, first and second side walls extending between the front wall and the rear wall to define a generally rectangular shape in plan view, the first side wall disposed opposite the second side wall, opposing grip areas formed in the first and second side walls, the opposing grip areas including a first grip area formed in the first side wall and a second grip area formed in the second side wall, one or more strengthening features selected from the group consisting of:

(i) at least one circumferential rib spaced from the opposing grip areas and extending horizontally about an entire outer circumferential perimeter of the body portion, and (ii) at least one horizontal body rib spaced about the outer circumferential perimeter from the opposing grip areas, and at least one vertical strut formed in at least one of the first side wall and the second side wall, the at least one vertical strut spaced from and having a length coextensive with a height of the opposing grip areas and configured to resist radially-inward distortion of the first and second side walls from gripping the opposing grip areas, wherein the container exhibits approximately a 200% decrease in displacement of volume upon application of a force of 2.27 lbs. to at least one of the opposing grip areas compared to a substantially similar container without the strengthening features.

29. The container of claim 1, wherein each of the first and second vertical struts comprises a vertical strengthening channel.

* * * * *